United States Patent [19]

Rowley

[11] 4,137,814

[45] Feb. 6, 1979

[54] NONSLIP GUITAR PICK

[75] Inventor: Peter C. Rowley, Santa Ana, Calif.

[73] Assignee: Roy Surrette, Santa Ana, Calif.

[21] Appl. No.: 842,756

[22] Filed: Oct. 17, 1977

[51] Int. Cl.[2] ..... G10D 3/16

[52] U.S. Cl. ..... 84/322

[58] Field of Search ..... 84/258, 320–322

[56] References Cited

U.S. PATENT DOCUMENTS

| | | | |
|---|---|---|---|
| Re. 23,458 | 1/1952 | Bowen | 84/320 |
| 555,599 | 3/1896 | Essig | 84/322 |
| 1,784,934 | 12/1930 | Johansson | 84/322 |
| 3,735,663 | 5/1973 | Cowell | 84/322 |

FOREIGN PATENT DOCUMENTS

| | | | |
|---|---|---|---|
| 219184 | 7/1924 | United Kingdom | 84/322 |

*Primary Examiner*—John Gonzales

*Attorney, Agent, or Firm*—Knobbe, Martens, Olson, Hubbard & Bear

[57] ABSTRACT

A nonslip guitar pick is disclosed, including a palm piece attached to the pick by means of a flexible connection, which palm piece and flexible connection cooperate to prevent the guitar pick from rotating in and slipping from the fingers of a guitar player.

10 Claims, 2 Drawing Figures

NONSLIP GUITAR PICK

BACKGROUND OF THE INVENTION

The present invention relates to guitar picks, and more particularly to picks designed to avoid rotation or sliding in the hand of a guitar player.

A guitar player often prefers to use a pick in strumming the strings of the instrument. The pick, which is usually held between the thumb and forefinger of the player's hand, is typically made of thin molded plastic and is generally triangular in shape, with at least one prominent point used in striking the strings.

The rotation and slippage of the guitar pick is a common problem among guitar players. After playing the instrument for a certain period of time, several conditions combine to cause the pick to slip from the grasp of the player. This slippage problem expresses itself in two distinct ways. First, the pick may rotate in the fingers of the player causing the point used for striking the strings to no longer be in proper position for accurate strumming. Secondly, the pick may slip entirely from the grasp of the player, oftentimes falling into the hollow body of the instrument and resulting in a prolonged delay in the performance.

Attempts to solve the slippage problem have focused on modifying the pick itself. For example, cork or sandpaper has been applied to the surface of the pick in an attempt to prevent slippage. Similarly, holes have been drilled in the pick at the point where the thumb and forefinger meet in order to produce a more secure grip on the pick.

These modifications have provided for inconsistent, and at best, temporary relief of the problem. Generally, these methods have insured a somewhat better grip on the pick, but the effects of perspiration and the force exerted on the pick due to striking it against the strings still result in slippage.

Furthermore, because of the persistence of this problem, the guitar player often tends to grip the pick very tightly in order to prevent slippage. It is not long before the fingers and the hand of the player become fatigued, he is unable to grip the pick securely, and slippage again occurs. The prior art picks have not dealt with this fatigue problem directly; thus, the above-described modifications again produce only temporary relief.

In summary, then, the primary disadvantages of prior art guitar picks are that they tend to rotate in the fingers of the player or slip entirely from his grasp. These problems result from the difficulty of securely holding the smooth plastic device while the fingers perspire and the hand is moving rapidly, the pick being in constant, forceful contact against the strings. Moreover, modification of the pick itself has provided at best only temporary relief from the rotation and slippage problems, as well as from fatigue.

SUMMARY OF THE INVENTION

The present invention offers a simple, yet novel solution to these problems. It prevents the rotation and slippage of the pick itself, and at the same time is easy and comfortable to hold, thereby reducing fatigue as well.

The concept of the present invention is to maintain a slight tensile force on the pick, apart from the compressive forces exerted on it by the fingers of the player, in order to maintain its proper orientation with respect to the strings and to prevent slippage. In the preferred embodiment, this tensile force is derived from a flexible chain which is attached to the pick at one end, and at the other end to a handle piece held in the palm of the hand. The tension in this chain, as produced by the extension of the thumb and forefinger of the player, supplies a correctional tensile force on the pick. Thus, the rotation and slippage of the pick in the fingers of the player are prevented.

Furthermore, the present invention helps to relieve the fatigue problem. Because of the function of the chain in cooperation with hand manipulation of the palm piece and pick, the player's grip on the pick need not be so tight. This more relaxed grip substantially reduces the fatigue that would relaxed grip substantially reduces the fatigue that would otherwise result.

The unique palm piece of the present invention is light and comfortable to hold. It is contoured to fit snugly into the space formed by the third, fourth, and fifth fingers and palm of the player's hand. Therefore, the player experiences no fatigue from holding this piece.

The guitar pick embodied in the present invention employs a basic force concept which enables it to display advantageous nonslip characteristics.

Experience has shown that despite the opposing compressive forces exerted on the guitar pick by the thumb and forefinger of the guitar player, the pick will, nonetheless, eventually rotate in the player's grasp, and often slips entirely from his grip. As explained above, this rotation and slippage is due to the slippery nature of the plastic material from which the pick is constructed, perspiration, fatigue, and the force of striking the pick against the strings in strumming the guitar.

In the present invention, the rotation and slippage of the guitar pick are prevented by exerting on one of its corners a third, tensile force, in addition to the two compressive forces of the thumb and forefinger. This third force maintains the orientation of the pick with respect to the strings of the guitar, and prevents its rotation in the fingers of the player.

The manner in which this tensile force is exerted on the guitar pick can be described as follows. Attached to one corner of the essentially triangular pick is, in the preferred embodiment, a chain. This chain is also attached to the palm piece, which is held between the third, fourth, and fifth fingers and palm of the playing hand. The design of the palm piece is such that it can be comfortably held by the last three fingers of the hand.

The length of the chain is, of course, important. It should be sufficiently long such that, when the pick and palm piece are held comfortably in the playing position, the chain is in tension and applies a residual tensile force on the pick. Should the pick begin to rotate, the thumb and forefinger can be slightly extended, thereby increasing the tension of the chain and the resultant tensile force exerted on the pick. This force will then cause the pick to return to its proper orientation.

In order to understand how this tensile force prevents the rotation of the pick, it is first important that one understand the basic principles of guitar pick configuration, pick orientation, and movements of the hand during guitar playing.

As mentioned above, the pick is essentially triangular in shape. One of its corners is more prominent and less rounded than the others, and for purposes herein will be referred to as the "point" of the pick. Similarly, it will be assumed that the guitar player is right handed.

In the initial playing position, the pick is held between the thumb and forefinger and is horizontally situated. It is helpful to imagine a vertical axis extending through the thumb, pick, and forefinger of the right hand. The point of the pick may be directed perpendicular to the plane formed by the strings, but it is more likely to be rotated slightly clockwise with respect to the perpendicular on the axis just described.

The movement of the hand and wrist during playing is essentially as follows. Starting above the strings, the hand moves downward so that the point of the pick contacts all of the strings. Generally, however, the arm will be held fairly close to the body and experiences little movement. Rather, the wrist will rotate from top to bottom in order to produce hand movement sufficient to bring the pick into contact with the strings. This combination of arm placement, lack of arm movement, and wrist rotation causes the point of the pick to conclude its course below the strings pointing in a downward direction and away from the strings. That is, the point of the pick will have rotated even further clockwise from its initial position.

The above-described arm and wrist movement, in conjunction with the forces exerted on the pick due to its contact with the strings of the guitar, causes the pick to tend to rotate clockwise in the fingers of the player about the imaginary vertical axis described above.

The present invention simply and efficiently prevents the clockwise rotation of the guitar pick in the fingers of a guitar player. In the preferred embodiment, a chain is attached to the corner of the pick which lies closest to the body of the player when the pick is in the initial playing position. The tension in this chain, which is caused by the distance separating the pick from the palm piece, prevents the rotation of the pick by exerting a countervailing tensile force on it. Thus, this rotational problem is solved by the action of the chain, in cooperation with the pick and the palm piece as manipulated by the hands of the guitar player.

The problem of complete slippage of the guitar pick from the hand of the guitar player is solved by the present invention in the same manner. To a large degree, the slippage of the pick is a result of its rotation in the fingers of the player. When the pick rotates, the point of the pick is angled away from the strings and, as a result, the blunted side of the pick is that part of it which strikes the strings. Therefore, a larger area is exposed to contact with the strings and a greater force is thereby inflicted upon the pick by the strings. This increased force results in two adverse effects: first, the greater the force exerted on the pick, the greater the likelihood of the pick slipping from the fingers of the player; second, the clockwise rotation of the pick will increase, and the problem will become more extreme.

Also, as the pick rotates, the fingers of the player will be gripping only one corner of the pick rather than two, resulting in a substantial reduction in the security of the grip. Due to the rotation of the pick, then, the chances of slippage are now much greater. Therefore, by preventing the rotation of the pick, the present invention simultaneously reduces the likelihood of its slipping completely from the fingers of the player.

A further advantage of the present invention is that by preventing the rotation and substantially preventing the slippage of the pick, a player need not be so concerned about gripping the pick tightly. As a result, the player's relaxed grip will reduce hand fatigue. Furthermore, as previously mentioned, because of the special design of the palm piece, no fatigue will be caused by holding it.

These and other advantages of the present invention are apparent by reference to the drawings in which:

FIG. 1 is a perspective view of the pick, including the manner in which it is held, its orientation with respect to the strings, and its rotation during the playing of the guitar; and FIG. 2 is a perspective view of an alternate combination of the present invention; including pick, alternate flexible connection and palm piece.

DETAILED DESCRIPTION OF THE PREFERRED EMBODIMENT

Figure 1:
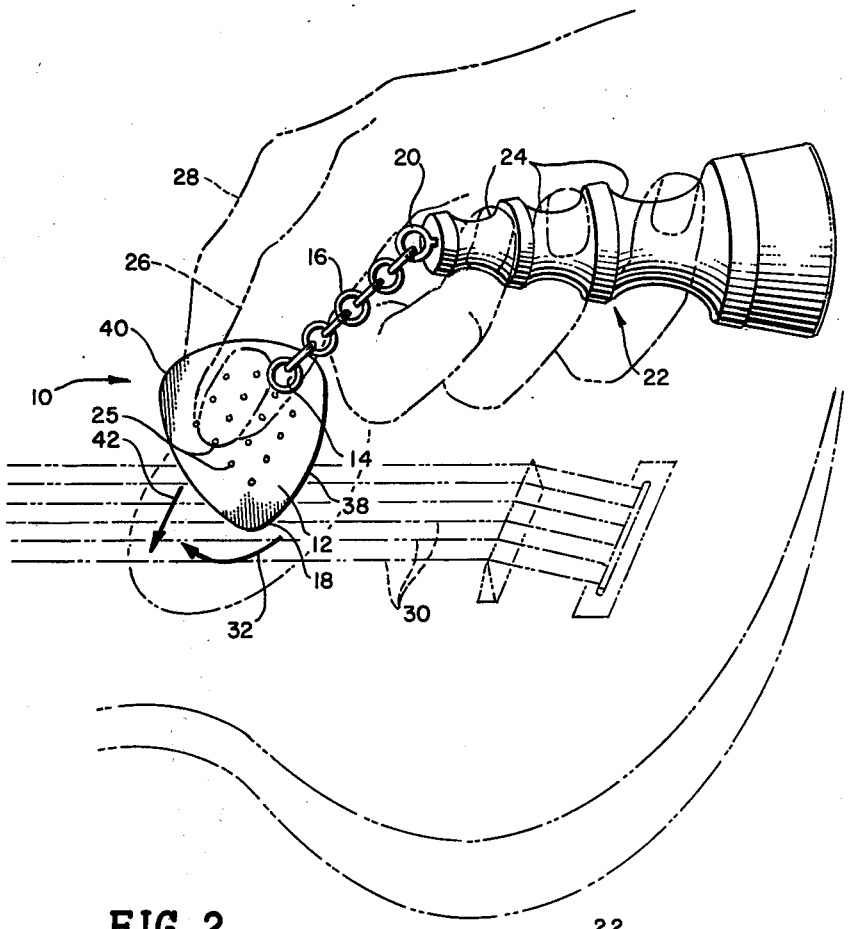

Referring to FIG. 1, there is shown the preferred embodiment of the present invention, a nonslip guitar pick 10. The guitar pick 12 itself is shown with a hole or perforation 14 which allows attachment of a flexible link chain 16. The point of the pick 18 is that portion which is used in strumming the strings of the guitar. The proximal end of chain 16 is attached to a rotating link 20 which is securely, but rotatably, fastened to palm piece 22. Rotation of this link 20 allows for the variable orientation of pick 12 with respect to palm piece 22, and for the free movement of the pick by the guitar player during a performance.

Palm piece 22 is shaped to provide annular recesses 24 which may be comfortably held between the third, fourth, and fifth fingers and the palm of the hand of the guitar player, as shown by the placement of the hand in FIG. 1. The pick 12 of FIG. 1 includes plural holes 25 as used in the prior art to increase resistance of the pick 12 to slippage.

As explained above, the concept of the present invention is to prevent the rotation and slippage of the guitar pick by exerting on it a tensile force which counteracts the rotational force exerted on the pick by the strings of the guitar in conjunction with hand and wrist movements. In the preferred embodiment, this tensile force is applied and maintained directly on pick 12 by a means of the flexible chain 16.

The tension in the chain itself is produced when the pick is comfortably held by the thumb and forefinger in the normal playing position, as shown in FIG. 1, while at the same time palm piece 22 is held in the palm of the playing hand. The importance of the length of the chain is apparent from the figure. If it is too long, no significant tensile force will be exerted on the pick; on the other hand, if it is too short, the excessive force exerted on the pick will cause its disorientation, or discomfort will result from attempting to hold the pick properly with respect to the strings. Finally, the chain should be of sufficient length such that, in the event the pick rotates, the player is able to extend his thumb and forefinger, thereby producing greater tension in the chain and a stronger force on the pick which returns it to its proper orientation.

The pick 12 is typically held between the thumb 26 and forefinger 28. The point 18 is either perpendicular to the strings 30 or slightly rotated in a clockwise direction 32. As described above, further rotation of the pick in the clockwise direction 32 is caused by the hand and wrist movement of the player in strumming the strings of the guitar. This rotation is prevented by the exertion of a force in the counterclockwise direction (opposite direction 32), exerted on the pick 12 at hole 14 by chain 16.

The pick, during play, may tend to slip completely from the fingers of the player primarily due to the rotation of the pick during playing. As the point 18 rotates in direction 32, more of a side 38 comes in contact with the strings, resulting in the exertion of a greater force upon the pick. This increased force also greatly increases the likelihood that the pick will slip from the fingers of the player. Furthermore, with the pick rotated, the thumb and forefinger of the player are left grasping only one corner 40 of the pick 12. This insecure grip also increases the chances of slippage of the pick. Therefore, the prevention of the rotation of the pick substantially reduces the likelihood of slippage of the pick from the fingers of the player.

In addition, it will be apparent that during play the pick 12 is continuously jarred in the hand of the player and there is a tendency for the pick 12 to simply slide out of the grip of the player and drop. Use of the present pick with the restraining force caused by the flexible chain 16 assures that the pick cannot fall out of the user's hand in a direction 42 away from the palm of the user's hand. In addition, if the pick falls in a different direction out of the player's grip, the player will nevertheless not lose the pick since it will remain attached to the flexible chain 16 and the player can again quickly grip the pick 12 to resume play.

Figure 2:
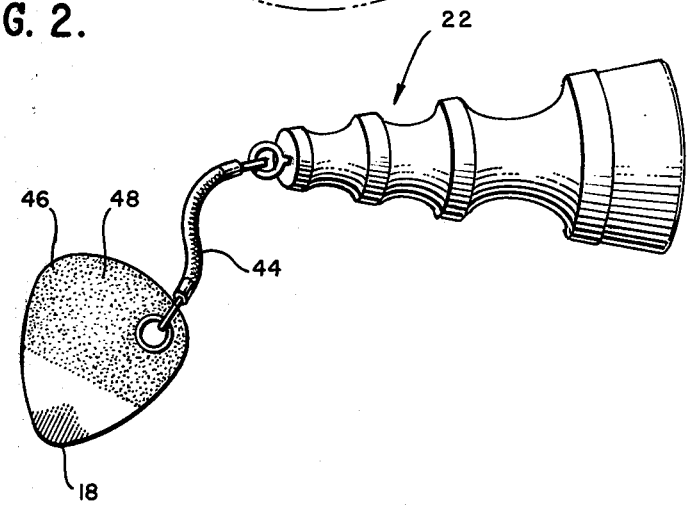

Referring to FIG. 2, an alternate form of the present invention is shown in which the flexible chain 16 of FIG. 1 is replaced by a flexible fabric link 44 which interconnects the palm piece 22 and a slightly modified pick 46. In this case, the pick 46 includes a sandpaper cover 48 on both surfaces, except the area immediately adjacent the point 18 of the pick. This sandpaper 48 is used to prevent slippage as much as possible and is used in the same manner as sandpaper in the prior art as an alternate to the holes 25 for preventing slippage and rotation of the pick 48. It can be seen from the embodiments of FIGS. 1 and 2 that any type of flexible linkage between the palm piece 22 and pick 12,46 may be used. In addition, it should be understood that the pick 12,46 may or may not have additional means such as the holes 25 or sandpaper 48 for preventing slippage. The present invention will also provide substantial advantages where the pick 12 has smooth gripping surfaces.

What is claimed is:

1. A pick for use with a musical instrument, comprising:

a pick element designed to be held by the thumb and forefinger of the hand for use in strumming the strings of said instrument;

a palm piece, designed to be securely held in the palm of the hand; and flexible connecting means between said pick element and said palm piece, said means transmitting exclusively a tensile force between said pick element and said palm piece when said pick element is held a sufficient distance from said palm piece, said tension maintaining the proper orientation of said pick element with respect to said strings and substantially preventing slippage of said pick from said thumb and forefinger.

2. A pick, as defined in claim 1, wherein:

said palm piece comprises:

a substantially cylindrical member including annular grooves and ridges which facilitate comfortable holding of said palm piece in the palm of the hand; and a rotating link; and wherein said flexible connecting means comprises a chain attached by means of said rotating link to said palm piece, said rotating link thereby allowing free movement of said chain about said palm piece.

3. A pick, as defined in claim 1, wherein said pick includes roughened surfaces to provide a firm grip.

4. A pick, as defined in claim 1, wherein said pick includes a hole therethrough to provide a firm grip between the thumb and forefinger.

5. A pick, comprising:

a pick element adapted to striking musical instrument strings;

a hand-held base member; and a connecting link between said pick element and said base, said link providing free relative rotation between said pick element and said base and disposed so as to be in tension upon appropriate hand manipulation of said pick element and said base member during use.

6. A nonslip musical instrument pick, comprising:

a pick element for striking the strings of an instrument; and anchor means attached to said pick element, comprising:

a base element sized to comfortably fit in the palm of a musician; and connection means linking said pick element to said base element said means allowing a musician to freely control the angular orientation of said pick element relative said base element while said means is maintained in tension by said pick element being held a sufficient distance from said palm piece.

7. A nonslip guitar pick, comprising:

a guitar pick element;

a hand-held anchor; and a flexible, elongate element freely rotatably mounting said pick element to said anchor, said elongate element transmitting exclusively a tensile force between said pick element and said anchor to maintain the desired orientation of said pick with respect to said anchor.

8. A pick for use with a musical instrument, comprising:

a flat pick element adapted to be grasped between the thumb and index finger of a player;

a palm piece designed to be securely held in the palm of the hand; and a limp connecting member attached to said pick element and said palm piece, said connecting member being incapable of maintaining the orientation of said pick element relative said palm piece except when said connecting means is placed in tension.

9. A method of preventing the rotation and slippage of a guitar pick from the hand of a user while playing the guitar comprising:

gripping a thin pick element which is connected by a flexible link to a base member between the thumb and forefinger of a user's hand;

holding said base member simultaneously in the palm of said hand; and extending said pick element a sufficient distance from said base member, said extension exclusively transmitting a tensile force through said flexible member which maintains the proper orientation of said pick element with respect to the strings of said guitar.

10. A method of playing a stringed instrument using a compound pick which includes a palm-gripped portion interconnected with a strumming portion, comprising:

gripping said palm-gripped portion in the palm of the hand;

gripping said strumming portion between the thumb and index finger; and orienting said strumming portion relative the palm-gripped portion by extending said thumb and index finger to move said strumming portion away from said palm-gripped portion.

* * * * *